United States Patent [19]

Roggo

[11] 4,124,059

[45] Nov. 7, 1978

[54] MOLD FOR CONTINUOUS CASTING OF MOLTEN METAL

[75] Inventor: Bernard Roggo, Hellemes, France

[73] Assignee: Fives-Cail Babcock, Paris, France

[21] Appl. No.: 835,053

[22] Filed: Sep. 21, 1977

[30] Foreign Application Priority Data

Sep. 28, 1976 [FR] France ..... 76 29041

[51] Int. Cl.[2] ..... B22D 11/04

[52] U.S. Cl. ..... 164/436; 249/158

[58] Field of Search ..... 164/435, 436, 418, 411, 164/270, 430; 249/158, 161, 162, 165, 166, 167

[56] References Cited

U.S. PATENT DOCUMENTS

| | | | |
|---|---|---|---|
| 3,710,845 | 1/1973 | Burkhardt | 164/436 |
| 3,913,658 | 10/1975 | Schmid | 164/435 |
| 3,964,727 | 6/1976 | Gladwin | 164/436 |

*Primary Examiner*—Francis S. Husar
*Assistant Examiner*—John S. Brown
*Attorney, Agent, or Firm*—Kurt Kelman

[57] ABSTRACT

A mechanism for controlling the displacement of a front wall of a continuous casting mold with respect to the edges of the lateral mold walls and for pressing the front wall tightly thereagainst comprises a threaded rod extending perpendicularly to the front wall and operable to displace it, a spring assembly arranged to press against the front wall, and a hydraulic jack arranged between the threaded rod and the front wall for compressing the spring assembly, the jack comprising a hydraulic fluid delivery conduit for supplying hydraulic fluid thereto, and the threaded rod being arranged to maintain the spring assembly compressed when the supply of hydraulic fluid to the jack is discontinued.

10 Claims, 2 Drawing Figures

MOLD FOR CONTINUOUS CASTING OF MOLTEN METAL

Figure 1:
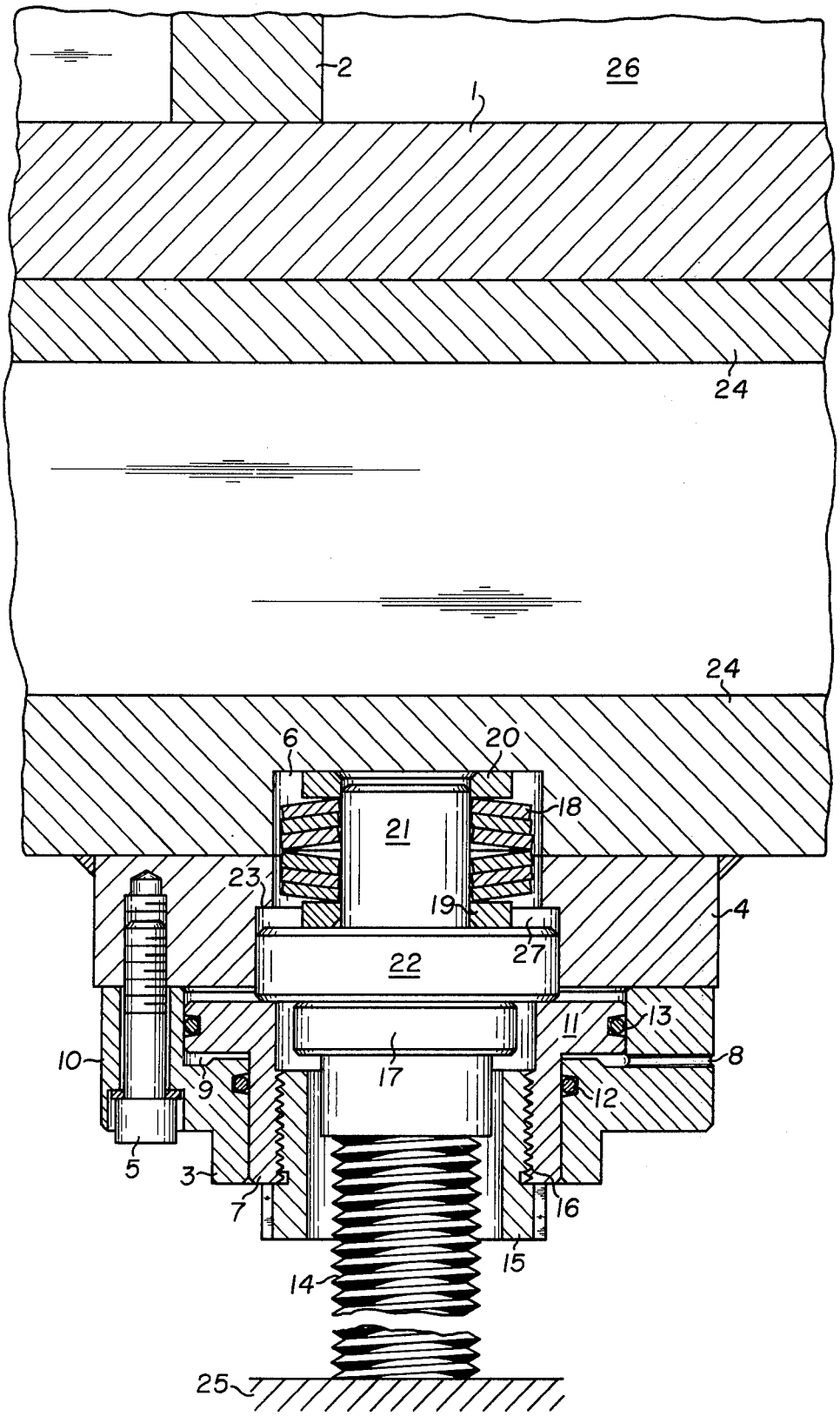

The present invention relates to improvements in a mold for the continuous casting of molten metal, which mold comprises a pair of lateral walls each having two edges and a pair of front walls each arranged for engagement with two respective ones of the lateral wall edges, the four mold walls defining a casting cavity for the molten metal, and a fixed structure supporting the walls, and more particularly to an improved mechanism for controlling the displacement of one of the front walls with respect to the respective edges of the lateral walls and for pressing the front wall tightly thereagainst.

Molds of this type are well known and it is also known that the continuous casting of molten metal frequently calls for the production of different types of products with quite different cross sections. To avoid the necessity of changing molds for this purpose, it has been proposed molds with movable walls so that the molding cavity defined thereby may be changed at will to obtain different cross sectional dimensions. In such molds, two lateral walls are usually arranged parallel to each other and two front walls are arranged to be pressed against the respective opposite edges of the lateral walls. To change the length of the rectangular mold cavity, it suffices to move the lateral walls together or apart while the width may be changed by replacing the lateral walls by walls of different dimensions. In either case, the front walls must be disengaged from their tight pressure contact with the edges of the lateral walls to permit displacement or replacement of the lateral walls, and they must then be moved back into tight pressure engagement with the lateral wall edges.

The displacement of the front walls of the mold is normally effected by mechanical means, such as screw mechanisms causing the displacement of an abutment affixed to the front wall, and it has also been proposed to interpose an elastic element in contact with the front wall. Normally, only one front wall is displaced while the second front wall remains fixed in position on the fixed structure mounting the walls of the mold.

This arrangement has the disadvantage that it requires considerable power to operate the screw mechanism and the amount of the force required for the operation is, in addition, difficult to control. The arrangement of the elastic element, while basically advantageous, also poses problems because it is susceptible to becoming inoperative when the rigid support on which it is mounted abuts the front wall, thus preventing any deformation of thereof.

It has also been proposed to replace the mechanical displacement mechanism by hydraulic jacks but this requires a constant supply of hydraulic fluid to the jacks, which is inconvenient.

It is the primary object of this invention to overcome these disadvantages.

This and other objects are accomplished in accordance with the invention by an arrangement wherein the elastic means is maintained compressed or prestressed by an otherwise conventional mechanism, such as a worm, its compression being first assured by a hydraulic jack mounted between the mechanism and the front wall to be displaced, the operation of the jack being subsequently discontinued.

More particularly, the mechanism for controlling the displacement of one of the front walls of the mold with respect to the respective edges of the lateral walls and for pressing the front wall tightly thereagainst comprises an elongated displacement device affixed to the fixed structure supporting the walls and extending perpendicularly to the front wall between the front walls and the fixed structure, the displacement device being operable to displace the front wall towards and away from the edges of the lateral walls, an elastic means arranged to press against the front wall, and at least one hydraulic jack arranged between the displacement device and the front wall and mounted to compress the elastic means. The jack comprises a hydraulic fluid delivery conduit for supplying hydraulic fluid thereto, and the elongated displacement device is arranged to maintain the elastic means compressed when the supply of hydraulic fluid to the jack is discontinued.

Figure 2:
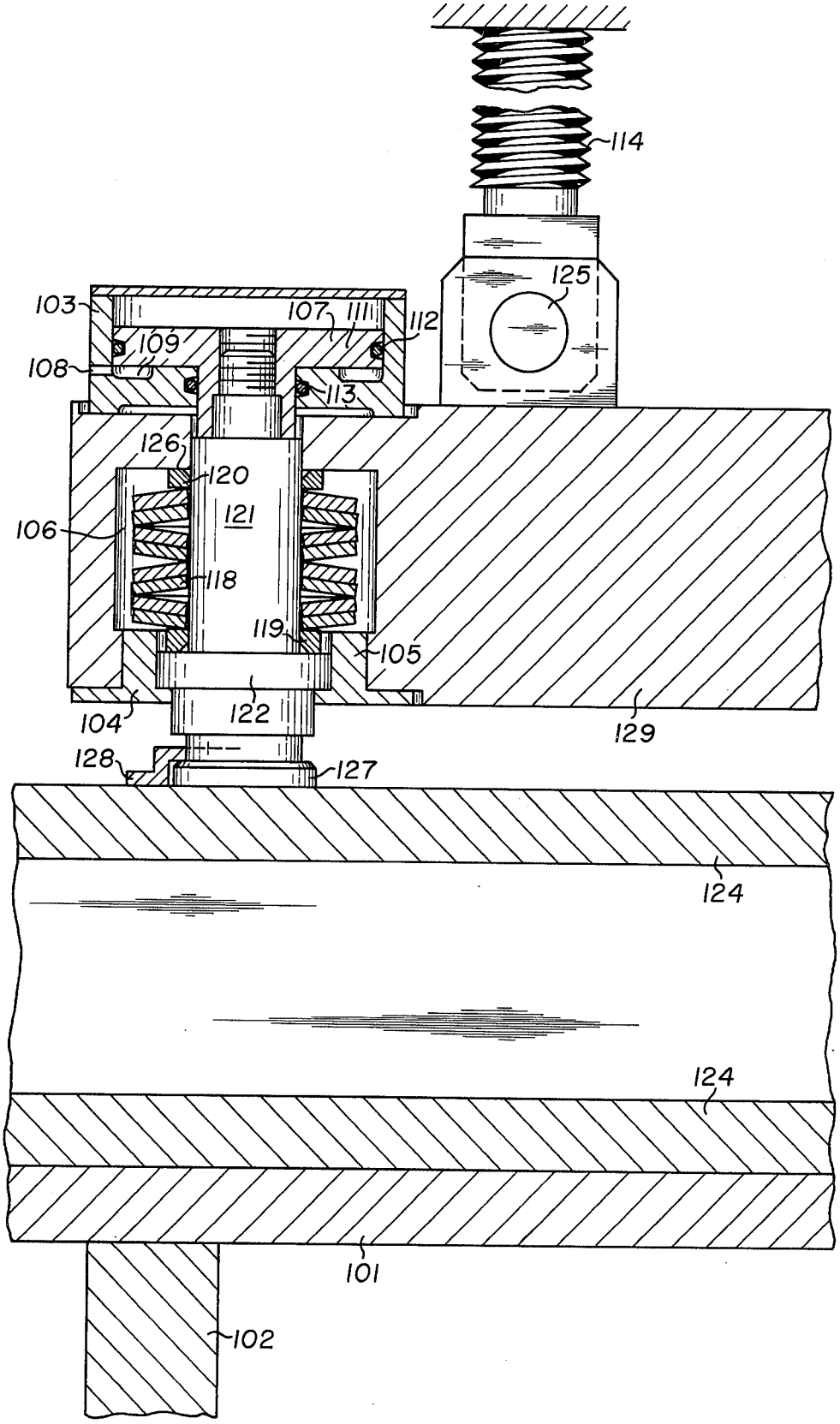

The above and other objects, advantages and features of the present invention will become more apparent from the following detailed description of now preferred embodiments thereof, taken in conjunction with the accompanying drawing wherein FIG. 1 shows a partial sectional view of one embodiment of a control mechanism according to this invention; and FIG. 2 shows a like view of another embodiment.

Referring now to the drawing and first to FIG. 1, there is shown only as much of a continuous casting mold, which is conventional, as is required for an understanding of the control mechanism of the invention. This mold comprises a pair of lateral walls, one lateral wall 2 being partially shown, and a pair of front walls, one front wall 1 being partially shown, the front walls being each arranged for engagement with two respective lateral wall edges for defining rectangular casing cavity 26 for the molten metal. As is also conventional, fixed structure 25, such as a casing, supports the walls of the mold. The lateral walls are arranged parallel to each other and may be displaced so as to change the dimension of the casting cavity, and the non-illustrated front wall is held in position against the two lateral wall edges opposite the side shown, all as conventional. As illustrated, front wall 1 comprises structural framework 24, such as a double-walled jacket, for receiving a cooling medium, for instance water, for the mold.

The illustrated mechanism for controlling the displacement of front wall 1 with respect to the respective edges of lateral walls 2 and for pressing the front wall tightly thereagainst comprises a hydraulic jack including cylinder 3 affixed to front wall 1. In the illustrated embodiment, the cylinder is affixed to the front wall by means of clamping plate 4, which may be welded or otherwise firmly attached to front wall jacket 24, and fastening bolt 5 mounting cylinder 3 on clamping plate 4. The clamping plate defines an axial bore in alignment with cylindrical recess 6 in the back wall of front wall framework 24, the bore and recess being coaxial with cylinder 3. The hydraulic jack further includes annular piston 7 mounted for displacement in cylinder 3, radial bore 8 in the cylinder providing a hydraulic fluid delivery conduit for supplying hydraulic fluid, such as oil, to cylinder chamber 9 for displacement of piston 7. The cylinder chamber is defined by the cylinder and piston, the cylinder comprising a section 10 of enlarged diameter adjacent clamping plate 4 for housing piston head 11 which may be displaced axially within the enlarged cylinder section under the pressure of hydraulic fluid supplied through bore 8. The end position of the piston is attained when piston head 11 abuts the surface of clamping plate 4. Toroidal gaskets 12 and 13 are arranged between the cylinder and piston of the hydraulic jack to assure fluid-tightness of cylinder chamber 9.

The illustrated mechanism further comprises an elongated front wall displacement device affixed to fixed structure 25 (which is only diagrammatically indicated) and extending perpendicularly to front wall 1 between the front wall and the fixed structure. This device is operable to displace the front wall towards and away from the edges of lateral walls 2. In the illustrated embodiment, this device includes threaded rod or screw 14 mounted along the common axis of hydraulic jack cylinder 3 and piston 7, which also is the axis of cylindrical recess 6 in the front wall. This screw is displaceable along this common axis by a suitable control mechanism, not shown and conventional per se, such as a worm for turning the screw, this control mechanism forming part of fixed structure 25. The hydraulic jack is arranged between this displacement device and the front wall, i.e. the back wall of front wall framework 24. Annular piston 7 has interal thread 16 for receiving bush 15 and screw 14 has head 17, the bush constituting an abutment for screw head 17 to limit axial outward displacement of the screw. In this manner, screw 14 will support front wall 1 by means of its jacket 24 when the front wall is disengaged from contact with the edges of lateral walls 2. It is operable to displace the front wall towards and away from the edges of the lateral wall in the manner of a push rod.

Furthermore, the illustrated mechanism also comprises an elastic means arranged to press against the front wall. In the illustrated embodiment, this elastic means is housed partially in cylindrical recess 6 and extends into the axial bore in clamping plate 4 so that it will press against the front wall under the operating conditions to be described hereinafter.

The illustrated elastic means comprises cylindrical body 21 passing coaxially through the axial bore in the clamping plate and recess 6, the cylindrical body having head 22 at one end thereof. An assembly of annular disc springs 18, of the type of Belleville disc springs, is mounted on cylindrical body 21, the disc spring assembly being held between collar 19 abutting head 22 and support collar 20 adjacent the front wall. Cylindrical body 21 is mounted for gliding in the direction of the axis and its gliding movement is guided and limited by head 22 which is housed in section 27 of the axial bore in clamping plate 4, this section having an enlarged diameter and forming shoulder 23 which constitutes one end position of gliding head 22 while its opposite end position is defined by abutment of the head with piston 7. The piston and screw 17 of the elongated front wall displacement device are in contact with head 22 of cylindrical body 21. Support collar 19 is mounted glidably on cylindrical body 21 and projects beyond the other end of the body whereby the other cylindrical body end is spaced from the front wall even when piston 7 of the hydraulic jack attains its end position, i.e. when the hydraulic pressure exerted upon springs 18 reaches its maximal value. In this position, support collar 20 presses against the back wall of jacket 24 of front wall 1 but the other end of cylindrical body 21 is spaced from the back wall.

While only one control mechanism has been illustrated, a plurality of like mechanisms will, in practice, be mounted on the front wall, for instance four such mechanisms, each being mounted on the front wall jacket whose back wall will, therefore, have four recesses 6. Each of these control mechanisms functions identically in a manner to be described hereinbelow.

Initially, the front and lateral walls of the mold are maintained in mutually engaging position to define closed casting cavity 26 in any suitable and conventional manner. When it is desired to change the casting cavity dimension by displacing or replacing the lateral walls of the mold, front wall 1 must be removed from contact with the two edges of the lateral walls, for which purpose threaded rod 14 is displaced along the axis of the hydraulic jack and in a direction perpendicular to the front wall. When it is desired to move the front wall back into contact with the lateral walls, threaded rod 14 is turned in the other directions until screw head 17 pushes against head 22 and subsequently entrains the front wall towards and finally into contact with the edges of lateral walls 2. When the front wall 1 is in contact with the lateral wall edges, the screw turning operation is concluded. It will be noted that it requires only a relatively small amount of power. Upon conclusion of this operating stage, hydraulic fluid, for example oil, is introduced into hydraulic cylinder chamber 9 through bore 8, for instance by means of a hand pump. The supply of hydraulic fluid causes annular piston 7 to be displaced in cylinder 3 and piston head 11 pushes against head 22 of cylindrical body 21, thus causing the disc springs 18 to be compressed between head 22 and support collar 20 pressing against the front wall. When the piston reaches its end position is abutment with the surface of clamping plate 4, the supply of hydraulic fluid to the jack is discontinued and screw 14 is turned again until screw head 17 depresses head 22, thus maintaining the disc springs compressed in the absence of any hydraulic pressure. The second operation of the screw again requires little power since the spring compression force is exerted by the hydraulic jack until it is taken over by the turned screw. At this point, no further hydraulic pressure is needed and the hydraulic fluid pump operation may be discontinued.

Front wall 1 is now in contact with the lateral wall edges under the pressure of compressed spring discs 18, support collar 20 being pressed into the bottom of recess 6 housing the spring discs. The support collar still projects beyond the inner end of cylindrical body 21 since the stroke of piston 7 is shorter than the spacing between the end of cylindrical body 21 and the bottom of recess 6. Thus, the full compressive power of the spring discs is assured since the cylindrical support body 21 for the springs never contacts the bottom of recessed spring housing 6, which would make the springs inoperative. Due to this arrangement, the force necessary to compress the elastic means 18 may be considerably reduced.

If desired, the same control mechanism, for instance a worm, may be used for simultaneously displacing all the elongated front wall displacement devices mounted on the front wall. These devices may be screws or any other push rod device axially displaceable towards the elastic means for compressing the same, any suitable means for displacing the devices being usable.

Also, the single hydraulic jack with an annular piston may be replaced by two separate jacks with cylindrical pistons between which the elongated displacement device is positioned to form a push rod. In this case, one displacement device or rod may advantageously maintain two separate elastic means under compression.

In the embodiment illustrated in FIG. 2, the front wall is designated by reference numeral 101 and the lateral wall of the mold is designated by reference numeral 102, the mold structure being identical with that described in connection with FIG. 1, i.e. the front wall carries jacket 124.

In this embodiment, the control mechanism for the displacement of the front wall includes support plate 129 to which displacement screw 114 is attached by means of pivot 125. The other end of the screw is again operated by a suitable means on the fixed structure which supports the mold walls. Support plate 129 extends parallel to front wall 101 and carries a plurality of elastic means operating in the same manner as the elastic means of FIG. 1, each of the elastic means being maintained in a prestressed state by means of a hydraulic jack associated therewith, in a manner to be described hereinafter.

Each hydraulic jack comprises cylinder 103 affixed to support 129 and piston 107 displaceable in the cylinder with its head 111. Bore 108 in the cylinder wall provides a conduit for the supply of hydraulic fluid to cylinder chamber 109, with toroidal gaskets 112 and 113 mounted to make the chamber fluid-tight, all in the manner described more fully in connection with FIG. 1. Cylindrical recess 106 in support 129 houses the elastic means whose cylindrical body 121 passes coaxially through cylindrical cavity 106 and has one end affixed to piston 107 of the jack. The other end of the cylindrical body has a head 122 abutting closure ring 104 mounted on support 129 over cavity 106, cylindrical body head 122 being glidingly guided in coaxial skirt 105 projecting from the closure ring. An assembly of annular disc springs 118 is mounted on cylindrical body 121 in cavity 106 between support collar 120 is arranged in the cavity adjacent shoulder 126 of cavity 106, another collar 119 being mounted in abutment with head 122 and the annular spring discs being held between head 122 of the cylindrical body and support collar 120. As the cylindrical body 121 with its head 122 axially glides under the pressure of piston 107, support collar 120 remains supported on shoulder 126 while permitting the cylindrical body to glide therethrough.

Head 122 of cylindrical body 121 has affixed thereto pressure and support element 127 constituted by a plate which applies the bias of elastic means 118 to front wall 101, plate 127 bearing against the back wall of jacket 124 on which it is held by clamping element 128. In this manner, the front wall is supported by support element 127.

When hydraulic fluid is supplied through bore 108 into cylinder chamber 109, piston 107 is displaced and entrains cylindrical body 121 attached thereto, causing the compression or prestressing of annular disc springs 118 between collars 119 and 120, the latter collar being pressed against shoulder 126. During this operation, front wall 101 is displaced by the push of support plate 127 which moves with the cylindrical body to which it is affixed. In this manner, front wall 101 is held under pressure against the lateral wall edges.

When screw 114 is turned for axial displacement, it entrains support 129 which carries elastic means 118 and the hydraulic jack which prestresses it. The turning of the screw is halted when front wall 101 abuts the edges of lateral walls 102. At this point, hydraulic fluid supply to the jack is disontinued and the bias of the compressed annular disc springs is exerted upon the front wall through support element 17 and jacket 124. The screw holding support 129 in position assures the maintenance of the spring compression.

While the present invention has been described and illustrated in connection with two now preferred embodiments, it will be understood by those skilled in the art that various modifications and changes in the specific support, jack, elastic means and elongated front wall displacement device structures may be made without departing from the spirit and scope of this invention, as defined in the appended claims.

I claim:

1. In combination with a mold for the continuous casting of molten metal, which mold comprises a pair of lateral walls each having two edges and a pair of front walls each arranged for engagement with two respective ones of the lateral wall edges, the four mold walls defining a casting cavity for the molten metal, and a fixed structure supporting the walls: a mechanism for controlling the displacement of one of the front walls with respect to the respective edges of the lateral walls and for pressing the front wall tightly thereagainst, the mechanism comprising (a) an elongated displacement device affixed to the fixed structure and extending perpendicularly to the front wall between the front wall and the fixed structure, the displacement device being operable to displace the front wall towards and away from the edges of the lateral walls, (b) an elastic means arranged to press against the front wall, and (c) at least one hydraulic jack arranged between the displacement device and the front wall and mounted to compress the elastic means, (1) the jack comprising a hydraulic fluid delivery conduit for supplying hydraulic fluid thereto, and (2) the elongated displacement device being arranged to maintain the elastic means compressed when the supply of hydraulic fluid to the jack is discontinued.

2. In the combination of claim 1, the jack comprising a cylinder affixed to the front wall and a piston displaceable in the cylinder, the piston being arranged to compress the elastic means against the front wall, and the elongated displacement device comprising a push rod maintaining the elastic means in compression on the front wall.

3. In the combination of claim 2, the piston of the jack being annular and the push rod passing coaxially through the annular piston.

4. In the combination of claim 2, the elastic means comprising a cylindrical body having a head at one end thereof, an assembly of annular disc springs mounted on the cylindrical body, and a support collar arranged adjacent the front wall, the annular disc springs being mounted between the head of the cylindrical body and the support collar, the piston and the displacement device being in contact with the head of the cylindrical body, and the support collar being mounted glidably on the cylindrical body and projecting beyond the other end thereof whereby the other cylindrical body end is spaced from the front wall when the piston of the jack attains its end position.

5. In the combination of claim 2, the front wall defining a recess housing the elastic means.

6. In the combination of claim 1, the jack comprising a cylinder and a piston displaceable in the cylinder to maintain the elastic means in a prestressed state; a support for the elongated displacement device, the cylinder of the jack being mounted on the support and the displacement device maintaining the support in position.

7. In the combination of claim 6, the support being constituted by a plate provided with a plurality of said jacks, and the elongated displacement device being pivotally mounted on the support plate.

8. In the combination of claim 6, the elastic means comprising a cylindrical body having a head at one end thereof, as assembly of annular disc springs mounted on the cylindrical body in a cavity in the support, and a support collar arranged in the cavity adjacent the support, the annular disc springs being mounted between the head of the cylindrical body and the support coilar, the support collar being mounted glidably on the cylindrical body; and a pressure element affixed to the head of the cylindrical body for applying the bias of the disc springs against the front wall when the supply of hydraulic fluid to the jack is discontinued.

9. In the combination of claim 8, a clamping element affixed to the front wall and the pressure element engaging the clamping element for support of the front wall.

10. In the combination of claim 1, the elongated displacement device including a threaded rod.

* * * * *